United States Patent [19]

Mayle

[11] Patent Number: 5,014,486

[45] Date of Patent: May 14, 1991

[54] ONE-PIECE SELF-COVERING TERMINATION BAR

[76] Inventor: Robert L. Mayle, 601 N. Stone St., Fremont, Ohio 43420

[21] Appl. No.: 557,605

[22] Filed: Jul. 24, 1990

Related U.S. Application Data

[63] Continuation-in-part of Ser. No. 271,726, Nov. 15, 1988.

[51] Int. Cl.[5] ..... E04F 19/02

[52] U.S. Cl. ..... 52/717.1; 52/287

[58] Field of Search ..... 52/717.1, 716, 287, 52/288, 408, 410, 96; 24/487, 543, 559

[56] References Cited

U.S. PATENT DOCUMENTS

| | | | |
|---|---|---|---|
| 2,910,033 | 10/1959 | Weisburg | 52/717.1 |
| 3,360,893 | 1/1968 | Wattelez | 52/105 |
| 3,481,087 | 12/1969 | Stafford . | |
| 3,481,090 | 12/1969 | Lizee . | |
| 3,505,773 | 4/1970 | Thomas . | |
| 4,204,376 | 5/1980 | Calvert . | |
| 4,308,704 | 1/1982 | Lloyd . | |
| 4,401,701 | 8/1983 | Wolters . | |
| 4,625,490 | 12/1986 | Baslow . | |
| 4,676,016 | 6/1987 | Phillips et al. . | |
| 4,805,330 | 2/1989 | Bubernak . | |

FOREIGN PATENT DOCUMENTS

| | | |
|---|---|---|
| 2008942 | 12/1970 | Fed. Rep. of Germany . |
| 2523453 | 9/1983 | France . |

*Primary Examiner*—Michael Safavi

*Attorney, Agent, or Firm*—Marshall & Melhorn

[57] ABSTRACT

A termination bar for covering an edge of a sheet of roofing material applied to an outer surface of a building includes a planar body, a cover and a hinge for pivotally connecting the cover to the planar body, all formed as an integral unit. Opposite longitudinally extending edge portions of the planar body are thicker than a central portion of the body and apertures for receiving fasteners are formed in the central portion. After the termination bar has been attached to the building over the edge of the roofing material by suitable fasteners, the cover is pivoted into a superposed position on the planar body. The cover is maintained in position by a first latching means formed on one edge of the cover and a cooperating second latching means formed on one edge portion of the body.

10 Claims, 1 Drawing Sheet

ONE-PIECE SELF-COVERING TERMINATION BAR

This application is a continuation-in-part application pending U.S. patent application Ser. No. 07/271,726, filed Nov. 15, 1988.

BACKGROUND OF THE INVENTION

The present invention relates generally to the construction of roofs for buildings and, in particular, to a termination bar for finishing the edge of installed roofing materials.

Many horizontal, curved or sloped roofs, especially on commercial or agricultural buildings' are covered with sheets of roofing material. The roofing material typically is manufactured in standard widths of a predetermined continuous length wound in a roll for transportation and storage. The roofing material is unrolled as is applied to the roof and cut to length. Typically, two or more strips must be installed side-by-side to cover the entire roof. The strips are attached to the roof by a suitable adhesive. In the case of a roof surrounded by a low wall, the strips of roofing material typically are cut longer than required for the roof and are extended up onto the inwardly facing generally vertical surfaces of the surrounding wall.

The roofing material is formed of a synthetic rubber or similar material which provides a watertight barrier. However, the joints between adjacent strips and the ends of the strips have a tendency to lift away from the surface to which they are adhered thereby allowing water to flow under the roofing material causing damage to the roof. One method of preventing the lifting of the edges of the roofing material is to utilize a termination bar which is held in place by fasteners and which applies pressure to the roofing material to maintain it adhered to the underlying surface. Currently available types of termination bars do not cover the heads of the fasteners which can produce an untidy and unsightly impression with respect to the newly installed roof covering.

SUMMARY OF THE INVENTION

The present invention concerns a termination bar formed from a flexible material for ease of storage, transportation and installation. The present invention also solves the problems associated with the prior art or known termination bars in that the termination bar according to present invention includes a hinged cover and latching mechanism for covering and hiding the fastener heads from view. The termination bar is formed as a continuous strip, typically by extruding a plastic material, which includes a generally planar central portion having a fastener receiving apertures formed therein at a predetermined regular spacing. The opposite longitudinally extending edges of the planar portion are thickened to concentrate the pressure along a pair of generally parallel sealing lines when the fasteners are installed.

Along one of the edges of the planar surface there is formed a hinge to which is pivotally attached a generally longitudinally extending cover. The opposite edge of the cover from the hinge includes one portion of a latching mechanism, the other portion of which is formed on the other one of the thickened edges. In a first embodiment the latching mechanism on the cover is a generally U-shaped inwardly extending lip which engages a longitudinally extending flange formed on the cooperating thickened edge of the planar portion.

In a first alternate embodiment, the cover portion has an outwardly extending male latching mechanism shaped like an arrowhead in cross section which cooperates with a similarly shaped longitudinally extending groove formed in the thickened edge. In a second alternate embodiment, an inwardly facing groove is formed in the thickened edge to accept an edge portion of the cover.

BRIEF DESCRIPTION OF THE DRAWINGS

The above, as well as other, advantages of the present invention will become readily apparent to those skilled in the art from the following detailed description of a preferred embodiment when considered in the light of the accompanying in which.

DESCRIPTION OF THE PREFERRED EMBODIMENT

Figure 1:
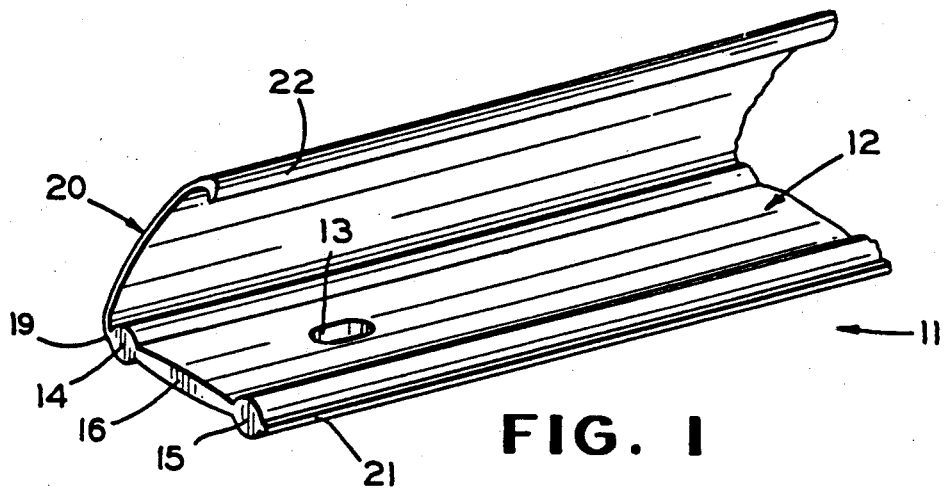
FIG. 1 is a fragmentary perspective view of a termination bar in accordance with the present invention.
Figure 2:
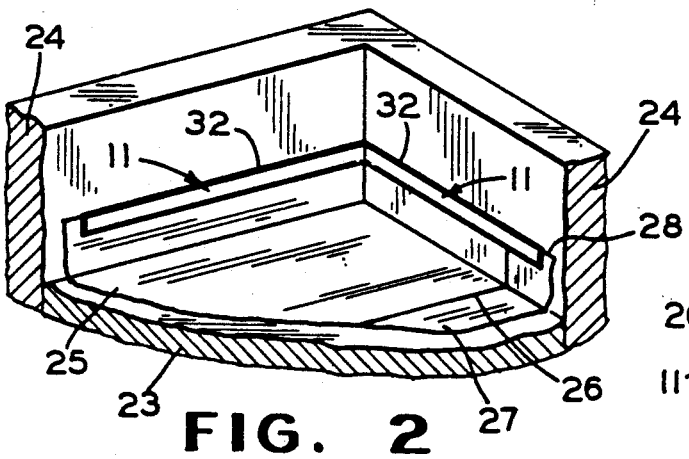
FIG. 2 is a fragmentary perspective view of the termination bar shown in FIG. 1 installed on a building roof.
Figure 3:
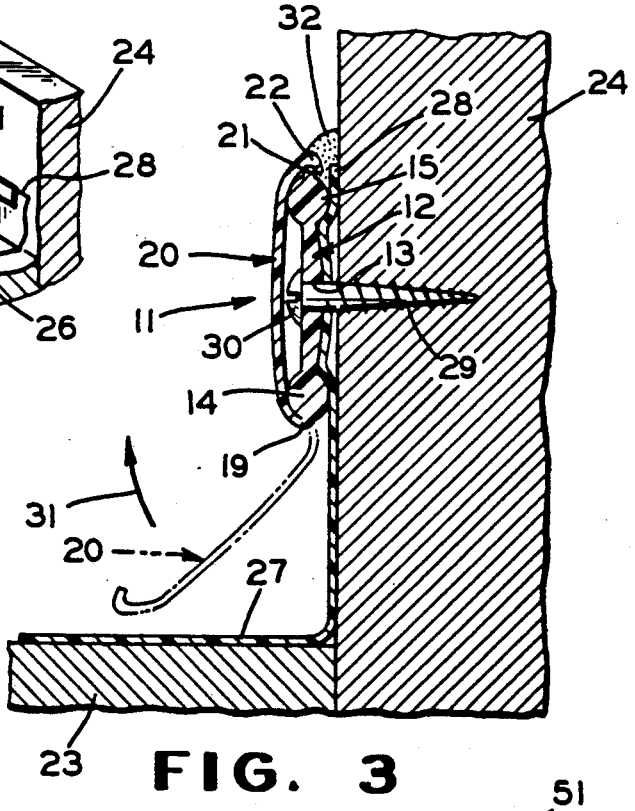
FIG. 3 is a fragmentary enlarged cross-sectional view of the building roof and termination bar shown in FIG. 2.
Figure 4:
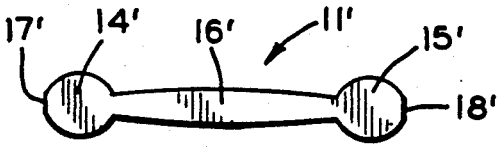
FIG. 4 (PRIOR ART)
FIG. 4 is an end elevational view of a prior art termination bar.

An embodiment of a termination bar in accordance with the present invention is shown in FIGS. 1–3. The termination bar 11 has a generally planar, longitudinally extending body 12. An aperture 13 is formed through a central portion of the body 12 and is representative of a plurality of such apertures which are typically spaced predetermined distances apart for accepting fasteners as will be discussed below. Opposite, generally parallel, longitudinally extending edge portions 14 and 15 of the planar body 12 are formed thicker than a central portion 16. The central portion 16, the first edge portion 14 and the second edge portion 15 are similar in cross-sectional shape to a prior art termination bar 11' shown in FIG. 4. The prior art termination bar 11' includes a central planar portion 16' attached to a first enlarged thickness edge 14' and an opposite parallel extending second enlarged thickness edge 15'. The first edge 14' includes an outwardly facing, generally flat, longitudinally extending side wall 17' and the second edge 15' includes a similar outwardly facing, generally flat, longitudinally extending surface 18'.

In the present invention, the prior art flat surfaces 17' and 18' have been replaced by a hinge and a portion of a latching mechanism respectively. As shown in FIG. 1, attached to an outer side wall of the first edge portion 14 is a hinge 19 which in turn is connected to a cover 20. Extending from a side wall of the second edge portion 15 is a longitudinally extending flange 21 which forms a portion of a cover latching mechanism as will be discussed below. A longitudinally extending edge 22 of the cover 20, opposite the hinge 19, is generally U-shaped and forms the remaining portion of the cover latching mechanism.

There is shown in FIGS. 2 and 3, a section of a generally horizontally extending roof 23. The edge of the roof 23 is bordered by a low, upstanding wall 24 which can be an extension of the side wall of the building. The roof 23 is covered by strips of roofing material. A first strip of roofing material 25 is adhered to the upper surface of the roof 23 and extends up the walls 24. Since the strip of roofing material 25 is typically not wide enough to cover the entire roof, an edge 26 of the strip of roofing material 25 overlaps an adjacent edge of a second strip 27 of the roofing material. As shown in FIGS. 2 and 3, the end of the second strip 27 also extends up the inner face of the side wall 24 and terminates in an edge 28.

The termination bar 11 according to the present invention can be formed of a flexible plastic material by any known manufacturing method such as extrusion. The termination bar can be cut to the desired length and installed along the edge 28 of the roofing material 27 as shown in FIG. 3. A fastener 29, such as a screw or a nail, is inserted through the aperture 13 in the planar body 12 and engages the wall 24 to maintain the termination bar 11 in place. The first edge portion 14 and the second edge portion 15 of the termination bar 11 engage the outwardly facing surface of the roofing material 27 and each forms a sealing line through pressure applied by the fastener 29.

During the installation of the termination bar 11, the cover 20 is in the position shown in phantom line in FIG. 3. After the fasteners 29 have been installed, a head 30 of each of the fasteners 29 is visible. The cover 20 can then be rotated about the hinge 19 in the direction of an arrow 31 to the position shown in solid line in FIG. 3. The U-shaped edge 22 of the cover 20 will tend to flex and can be forced over the projecting flange 21 and then returned to its original shape to lockingly engage the flange 21. Now all of the heads 30 of the fasteners 29 are hidden from view by the cover 20 which provides a pleasing appearance and a finished look to the new roof covering. As a final step, a caulking material 32 can be applied over the U-shaped edge 22, the edge 28 of the roofing material 27 and the adjacent inwardly facing surface of the wall 24 to seal against water and ice.

Figure 5:
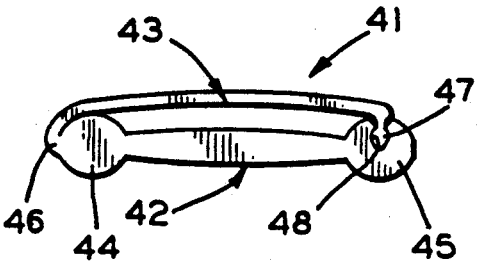
FIG. 5 is an end elevational view, similar to FIG. 4, of an alternate embodiment of the present invention.

The latching mechanism formed by the flange 21 and the U-shaped edge 22 is not limited to any particular form. As shown in FIG. 5, an alternate embodiment termination bar 41 has a planar body 42 with a cover 43 and generally parallel longitudinally extending, enlarged thickness side edge portions 44 and 45. One edge of the cover 43 is attached to the first edge portion 44 by a hinge 46 and the other edge of the cover 43 has a generally outwardly extending male fastener 47 formed thereon The male fastener 47 is formed generally in the shape of an arrowhead in cross section, having a thicker outer edge portion and a thinner inner edge portion where it is attached to the edge of the cover 43. A longitudinally extending groove 48 is formed in an upper surface of the second edge portion 45 and has substantially the same cross section as the male fastener 47. The termination bar 41 is made of a flexible material which permits the cover 43 to pivot about the flange 46 and also permits the side walls of the groove 48 to be forced apart as the male fastener is inserted and then spring back to the original shape to retain the male fastener 47.

Figure 6:
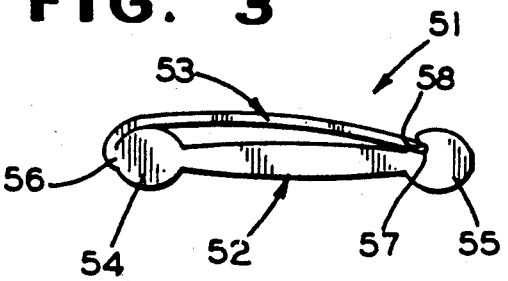
FIG. 6 is an end elevational view, similar to FIG. 5, of a second alternate embodiment of the present invention.

A second alternate embodiment termination bar 51 is shown in FIG. 6. The termination bar 51 includes a generally planar body 52 and a cover 53. The body 52 has a first thicker edge portion 54 and a generally parallel extending second thicker edge portion 55. The cover 53 is attached to the thicker edge portion 54 along one edge by a longitudinally extending hinge 56. An opposite edge of the cover 53 forms a longitudinally extending male fastener portion which engages a longitudinally extending groove 58 formed in the thicker edge portion 55. The groove 58 opens generally in the direction of the first thicker edge portion 54 and functions as a female fastener for retaining the edge portion 57 of the cover 53. Although several forms of latching mechanisms or fasteners have been shown for maintaining the cover of the termination bar in a closed position, other equivalent designs could be utilized.

In the illustrated latching mechanisms, one edge of the cover forms the first latching means; such as the edge 22, the male fastener 47 and the edge 57 are first fastener means or first latching means. One edge portion of the body forms the second latching means; such as the flange 21, the groove 48 and the groove 58 are second fastener means or second latching means. In each embodiment, the other edge of the cover is connected to the other edge portion of the body by a hinge (19, 46 and 56). The thicker edge portions (14 and 15. 44 and 45, 54 and 55) extend above the upper planar surface and below the lower planar surface of the respective central portions of the bodies (16, 42, 52). Thus, the thicker edges engage and the central portion of the body is spaced from a surface on which the termination bar is to be installed. When the lower surfaces of the thicker edges engage a surface on which the termination bar is to be installed, the lower surfaces form a pair of generally parallel sealing lines and the sealing function is aided by installing fasteners.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A termination bar adapted to be secured to a building to cover an edge of a sheet of roofing material, comprising:

a longitudinally extending planar body having a generally planar central portion extending between a pair of edge portions thicker than said central portion, each of said edge portions extending below a lower surface of said central portion and a lower surface of said edge portions adapted to engage a surface to form a pair of sealing lines;

a longitudinally extending cover having a pair of generally parallel edges, one of said edges forming a first latching means and one of said edge portions forming a second latching means; and a longitudinally extending hinge attached between the other one of said edge portions and the other one of said edges, said body, said cover and said hinge being formed of a flexible material whereby a continuous length of the termination bar can be wound in a coil, said cover can be pivoted about said hinge to superpose said cover on said body and at least one of said first and second latching means flexes under pressure to engage the other of said first and second latching means to maintain said cover in said superposed position.

2. The termination bar according to claim 1 including at least one aperture formed in said planar body for receiving a fastener means.

3. The termination bar according to claim 1 wherein said first fastener latching means is a generally U-shaped longitudinally extending lip and said second fastener latching means is a longitudinally extending flange.

4. The termination bar according to claim 1 wherein said first fastener means is a generally outwardly extending male fastener and said second fastener means is a cooperating longitudinally extending groove.

5. The termination bar according to claim 4 wherein said male fastener is thicker along its outer edge than adjacent said cover and said groove has a similar cross-sectional shape.

6. The termination bar according to claim 4 wherein said male fastener is an outer edge of said cover and said groove opens toward said one edge of said planar body.

7. The termination bar according to claim 1 including a plurality of apertures formed in said planar body each for receiving a fastener means for attaching the termination bar to a building.

8. The termination bar according to claim 1 wherein said first latching means is a longitudinally extending male fastener thicker at an outer edge than at an inner edge and said second fastener latching means is a longitudinally extending groove having a similar cross-sectional shape.

9. The termination bar according to claim 1 wherein said first latching means is said one of said edges and said second latching means is a longitudinally extending groove which opens toward the other edge portion of said body.

10. A termination bar adapted to be secured to a building over an edge of a sheet of roofing material, comprising:

a longitudinally extending generally planar body having a central portion with a plurality of apertures formed therein for receiving fasteners;

a first longitudinally extending edge portion formed on and thicker than said planar body central portion;

a second longitudinally extending edge portion formed on and thicker than said planar body central portion, said first and second edges each having a lower surface extending below a lower surface of said planar body central portion and adapted to engage a surface to form a sealing line when pressure is applied to said body by a fastener;

a generally planar longitudinally extending cover;

a hinge extending longitudinally and pivotally attaching said first edge portion to an edge of said cover;

a first latching means formed on an opposite edge of said cover; and a second latching means formed on said second edge portion for cooperation with said first latching means, at least said hinge and said first and second latching means being formed of a flexible material.

* * * * *